US005236799A

United States Patent [19]

Chen et al.

[11] Patent Number: 5,236,799

[45] Date of Patent: Aug. 17, 1993

[54] ELECTROPHOTOGRAPHIC TONER COMPOSITION

[75] Inventors: Fu-Lung Chen, Hsinchu; Hun-Yi Tong, Miaoli; Chao-Wen Niu, Hsinchu, all of Taiwan

[73] Assignee: Industrial Technology Research Institute, Hsinchu, Taiwan

[21] Appl. No.: 803,322

[22] Filed: Dec. 4, 1991

[51] Int. Cl.[5] ..... G03G 9/087

[52] U.S. Cl. ..... 430/109; 430/110

[58] Field of Search ..... 430/109, 110

[56] References Cited

U.S. PATENT DOCUMENTS 4,206,247 6/1980 Mitsuhashi et al. ..... 430/120
4,556,624 12/1985 Gruber et al. ..... 430/110
4,557,991 12/1985 Takagiwa et al. ..... 430/109
4,579,908 4/1986 Fujii ..... 525/106

*Primary Examiner*—John Goodrow
*Attorney, Agent, or Firm*—Scully, Scott, Murphy & Presser

[57] ABSTRACT

An electrophotographic toner composition for development of images, comprising:

(a) an amount of 45 to 95% by weight of resin of which the dynamic viscosity after compounded and being fixed onto rollers, having been tested at a frequency rate of 6.28 RAD/sec, a strain of 10% being less than 20000 poise and dissipation factor being smaller or equal to 1.3, and (b) a releasing agent being less than 3% by weight.

6 Claims, No Drawings

ELECTROPHOTOGRAPHIC TONER COMPOSITION

BACKGROUND OF INVENTION

The present invention relates to an electrophotographic toner composition, in particular, to a toner or developer composition used in a copy machine, laser printer or facsimile machine.

U.S. Pat. No. 4,556,624 to Gruber et al entitled "TONER COMPOSITIONS WITH CROSSLINKED RESINS AND LOW MOLECULAR WEIGHT WAX COMPONENTS" discloses an improved, positively charged electrostatic toner composition comprised of a polyblend mixture of a crosslinked copolymer composition and a second thermoplastic polymer, pigment particles, a wax component and a charge enhancing additive.

U.S. Pat. No. 4,557,991 to Takagiwa et al entitled "TONER FOR DEVELOPMENT OF ELECTROSTATIC IMAGE CONTAINING BINDER RESIN AND WAX" discloses a toner for development of electrostatic image which is comprised of a resin binder selected from a polyester resin, a vinyl polymer, a styrene-butadiene copolymer, etc. and a wax, wherein the wax is comprised of a polyolefin which has been block copolymerized or grafted copolymerized with an aromatic vinyl monomer.

Generally, the development of electrophotography consists of the steps of: (a) the distributing of electricity on a photo conductor, (b) exposure to form an electrostatic image, (c) developing an electrostatic image by using toner composition, (d) transferring the toner onto paper or transparency, (e) fixing the toner onto the paper or transparency, and (f) removing the toner residue from the photo conductor. Generally the fixing method consists of cold pressing and thermal pressing. In the cold pressing method, due to the large amount of wax contained in the toner, the quality of the copied article is poor. In the method of thermal pressing, due to the fact that the toner is in contact with the heated roller, offsetting printing will occur, i.e. during the fixing step the toner will adhere to the heated roller and after that it will print onto the copied paper. To avoiding these drawbacks and prevent the offsetting occurrence, U.S. Pat. No. 4,579,908 instructs on the introduction of silicone oil onto the heated roller. However, in order to carry out this method, the roller is made very complicated and is thus prone to contamination. Therefore, in order to prevent offsetting, it is suggested that no silicone oil or just a little silicone oil be introduced onto the heated roller. Under this requirement, it is desired that the toner have the anti-offsetting property.

In some prior references, such as U.S. Pat No. 4,206,247 and 4,556,624, it is suggested that low molecular weight wax be added to the toner as a releasing agent. The common waxes which can be used, for instance, are polyethylene or polypropylene wax having a molecular weight of 1000 to 5000. The amount of wax added to the toner ranging from 2% to 20%, preferably 5% to 10%. The addition of the low molecular weight wax will solve the problem of offsetting, however, the low melting point and high adhesive property of the wax may cause the following drawbacks: (A) The toner will adhere onto the developing sleeve of the coping or printing apparatus, (B) poor storage, i.e. the toner will form an agglomeration after a period of storage, and (C) the flowability of the toner is poor. Due to the aforementioned drawbacks, the quality of the print is poor. In order to upgrade the flowability, hydrophobic silica is added. The amount added is about 0.5%. However, silica is a very hard material, thus the photo sensing rod may easily be scratched. In particular, the currently used organic photo sensing body will be scratched. Besides, the electrical resistance of the silica is relatively low, and thus the resolution of the copied pattern will be lowered.

In order to upgrade the flowability of the low molecular weight, U.S. Pat. No. 4,557,991 discloses the use of polyethylene grafted aromatic monomer to substitute for the commonly used low molecular weight wax. However, the grafted polyethylene wax and the toner resin are good compatible pairs, and thus the releasing property is poor. As a result, the amount of the grafted aromatic monomer must be increased so as to produce an anti-offsetting effect. In addition, the cost of polyethylene grafted aromatic monomer is higher than that of the common low molecular weight wax. This will causes an increase in the cost of the toner composition.

SUMMARY OF THE INVENTION

Accordingly, it is an object of the present invention to provide an electrophotography toner composition which overcomes the above drawbacks and disadvantages.

It is an object of the present invention to provide an electrophotographic toner composition having excellent anti-offsetting property, and high fluidity.

It is another object of the present invention to provide an electrophotographic toner composition which can be employed on heated roller without the introduction of silicone oil.

It is yet another object of the present invention to provide an electrographic toner composition which is to be used in copying machines and laser printers.

These and other objects, advantages and features of the present invention will be more fully understood and appreciated by reference to the written specifications.

DETAILED DESCRIPTION OF THE INVENTION

The dry-type toner used in the electronic imaging apparatus is divided into single component and dual component, wherein the constituent of the single component includes resins, charge control agent, low molecular wax, colorants, magnetic powder and other additives. The resin used in the toner can be selected from the group consisting of styrene-acrylic copolymer, polyester, styrene-butadiene copolymer, etc., wherein the styrene-acrylic copolymer is obtained from the copolymerization of styrene, alpha-methyl-styrene, p-methyl styrene, o-methyl styrene, or m-methyl-styrene monomer and acrylic monomers, and the styrene-butadiene copolymer is selected from the group consisting of styrene, alpha-methyl styrene, p-methyl styrene, o-methyl styrene, or m-methyl styrene, and butadiene copolymer. The magnetic powder is selected from the group consisting of $Fe_3O_4$, and $Fe_2O_3$. Charge control agents can be selected from the group consisting of Nigrosin dye, metal AzO complex, etc. Low molecular wax can be selected from the group consisting of polyethylene or polypropylene wax and metallic stearate. Common colorants can be selected from the group consisting of carbon black, Aniline Blue, Copper Phthalocyanine, etc. In accordance with the present invention, the preparation of toner composition is comprised of the steps of mixing of raw materials, compounding, cooling and cutting, coarse crushing, fine crushing, grading and surface treating.

Based on their application on the types of photocopier, the single component of the dry type toner includes the magnetic and non-magnetic, wherein the copiers which use magnetic toner for instance Xerox Copier (resins 45%, magnetic toner 55%), Cannon Copier (resin 63%, magnetic toner 37%). The non-magnetic toner is used for example in IBM printer (resin 90 to 95%). The amount of resin is used in accordance with various type of copier. For the dual component toner, beside the toner composition a carrier may also added, wherein the amount of toner composition is 1 to 5%. The amount may be varied based on the different type of copier. In accordance with the present invention, tan $\leqq 1.3$ and viscosity $<20000$.

In accordance with one aspect of the present invention, to provide a high fluidity, and an excellent anti-offsetting property toner, it uses less or no low molecular weight wax, for instance at an amount of less than 3%. Under such a condition, it is found out that the low molecular weight wax contents provide excellent anti-offsetting and fixing properties. Besides, the rheological properties of the resin should be appropriate. If the dynamic viscosity ($\eta$) is too high, fixing cannot occur, and if the dissipation factor (tan $\delta$) is too great, then offsetting will occurred. In other words, if the used resin is at a rheological properties having dynamic viscosity less than 20000 poise, the dissipation factor $<1.3$, and the low molecular weight wax is as little as below 3%, excellent anti-offsetting and fixing properties can be obtained. Due to the minimal amount of low molecular weight wax used, the small amount of hydrophobic $SiO_2$ will provide excellent fluidity. As a result, the toner composition in accordance with the present invention has little resistance on the photo sensitive body. Besides, the resolution of the images formed is comparatively higher.

There is a close relationship between the fluidity and the quality of the copied article. Generally speaking, for poor fluidity, agglomeration may be formed and unevenness and inconsistency in copying will occur. To determine the quality of the fluidity of the toner, Powder Characteristics Tester (produced by Hosokawa Micron, Japan) is used to measure the flowability index. The higher the index, the better the flowability, otherwise, the flowability is poor.

The following examples are offered to aid in understanding the present invention and are not to be construed as limiting the scope thereof. Unless otherwise indicated, all parts and percentages are by weight.

BINDER RESINS

1. Resin R1

Styrene-acrylic copolymer (trade-name Himer TB-1000F, product from Sanyo Kasei, Japan).

2. Resin R2

Cross-linked Styrene-acrylic copolymer (trade-name, ORG D-71, product from Hercules, Inc., USA).

3. Resin R3

Cross-linked Styrene-acrylic copolymer (trade-name, Piccotoner, product from Hercules, Inc., USA).

4. Resin R4

80 parts of styrene, 20 parts of butylacrylate, 1 part of azobisisobutyronitrile, AIBN, 0.9 parts of dodecyl mercaptan, 1.1 parts of divinyl benzene are mixed and undergo suspension polymerization at 65° C. for 6 hours and at 85° C. for 4 hours. The obtained product is then washed and dried.

5. Resin R5

Under similar reaction with that of Resin R4 except styrene 80 parts, butylacrylate 20 parts, 1 part azobisisobutyronitrile, AIBN, 0.5 parts of dodecyl mercaptan, 1.5 parts of divinyl benzene.

6. Resin 6

Under similar reaction with that of Resin R4 except styrene 65 parts, butylacrylate 35 parts, 2 parts azobisisobutyronitrile, AIBN, 0.9 part of ethylene glycol dimethacrylate.

7. Resin 7

Under similar reaction with that of Resin R4 except styrene 80 parts, butylacrylate 20 parts, 2 parts azobisisobutyronitrile, AIBN, 0.9 parts of dodecyl mercaptan, 1.1 parts of ethylene glycol dimethacrylate.

8. Resin 8

Under similar reaction with that of Resin R4 except styrene 80 parts, butylacrylate 20 parts, 2 parts azobisisobutyronitrile, AIBN, 1.20 parts of dodecyl mercaptan, 0.9 parts of ethylene glycol dimethacrylate.

9. Resin 9

It is formed by mixing 70 parts of the Resin R4 and 30 parts of R1 resin.

10. Resin 10

It is formed by mixing 60 parts of the Resin R4 and 40 parts of R1 resin.

The above resins (R1 to R4) individually undergo melt compounding at 150° C. and then the following are determined: the dynamic viscosity ($\eta$), and dissipation factor ( tan $\delta$) at 180° C. under the conditions of dynamic testing rate, 6.28 RAD/sec, strain 10% by a Rheometer (RMS-605, Rheometrics, Inc., USA). The results of the determination are as below:

Table Dynamic Rheological Properties

| Resins | poise | tan |
|---|---|---|
| R1 | 1530 | 2.4 |
| R2 | 5600 | 1.43 |
| R3 | 2000 | 1.74 |
| R4 | 20,000 | 0.60 |
| R5 | 25,000 | 0.40 |
| R6 | 12,000 | 0.73 |
| R7 | 7100 | 0.84 |
| R8 | 5500 | 1.10 |
| R9 | 14,000 | 0.65 |
| R10 | 9600 | 0.75 |

EXAMPLE 1

63 parts of resin R6, 1 part of low molecular weight wax (Viscol 550P, product from Sanyo Kasei Japan), 36 parts of magnetic powder (Mapico Black B, product from Columbian Chemical Company), and 2 parts of negatively charged control agent (S-34, product from Orient Chemical Japan) underwent sufficient compounding, cooling and cutting, coarse crushing, fine crushing, and grading to form particles of 5 to 30 μm. The particles were treated with 0.2% hydrophobic $SiO_2$ (R-972, product from Degussa AG) to obtain copying powder.

EXAMPLE 2

63 parts of resin R7, 1 part of low molecular weight wax (Viscol 550P, Sanyo Chemical Japan), 36 parts of magnetic powder (Mapico Black B, Columbian Chemical Company), and 2 parts of negatively charged controlling agent (S-34, Orient Chemical Japan) underwent sufficiently compounding, cooling and cutting, coarse crushing, fine crushing, and grading to form particles of 5 to 30 μm. The particles were treated with 0.2% hydrophobic $SiO_2$ (R-972, product Degussa AG) to obtain toner.

EXAMPLE 3

63 parts of resin R8, 1 part of low molecular weight wax (Viscol 550P, product from Sanyo Kasei Japan), 36 parts of magnetic powder (Mapico Black B, product from Columbian Chemical Company), and 2 parts of negatively charged control agent (S-34, product from Orient Chemical Japan) underwent sufficient compounding, cooling and cutting, coarse crushing, fine crushing, and grading to form particles of 5 to 30 μm. The particles were treated with 0.2% hydrophobic $SiO_2$ (R-972, product from Degussa AG) to obtain toner.

EXAMPLE 4

63 parts of resin R9, 1 part of low molecular weight wax (Viscol 550P, product from Sanyo Kasei Japan), 36 parts of magnetic powder (Mapico Black B, product from Columbian Chemical Company), and 2 parts of negatively charged control agent (S-34, product from Orient Chemical Japan) underwent sufficient compounding, cooling and cutting, coarse crushing, fine crushing, and grading to form particles of 5 to 30 μm. The particles were treated with 0.2% hydrophobic $SiO_2$ (R-972, product from Degussa AG) to obtain toner.

EXAMPLE 5

63 parts of resin R10, 1 part of low molecular weight wax (Viscol 550P, product from Sanyo Kasei Japan), 36 parts of magnetic powder (Mapico Black B, product from Columbian Chemical Company), and 2 parts of negatively charged control agent (S-34, product from Orient Chemical Japan) were sufficiently compounded, cooled and cut, coarse crushed, fine crushed, and graded to form particles of 5 to 30 μm. The particles were treated with 0.2% hydrophobic $SiO_2$ (R-972, product from Degussa AG) to obtain toner.

EXAMPLE 6

45 parts of resin R8, 1 part of low molecular weight wax (Viscol 550P, product from Sanyo Kasei Japan), 54 parts of magnetic powder (Mapico Black B, product from Columbian Chemical Company), and 2 parts of positively charged control agent (NO1, product from Orient Chemical Co., Japan) were sufficiently compounded, cooled and cut, coarse crushed, fine crushed, and graded to form particles of 5 to 30 μm. The particles were treated with 0.2% hydrophobic $SiO_2$ (R-972, product form Degussa AG) to obtain toner.

The toner composition obtained was tested by using Xerox 2770 Copier. The flowability indexes were tested by the use of the Powder Property Testing Device (Hosokawa Micro Japan) and copied by using Xerox 2770 Copier. The fixing temperature was 180° C. and copying was carried out to copy for 2000 copies. The copying qualities such as consistency in copying, fixing property and transfer printing were determined. The storage property was tested by storing the boxes of the individual toner composition into an oven at 50° C. for 24 hours. If the toner compositions were aggloerated, it shows that the storage property is poor. The tested result of this example is also shown in Table 2.

EXAMPLE 7

92 parts of resin R7, 1 part of low molecular weight wax (Viscol 550P, product from Sanyo Kasei Japan), 7 parts of carbon black (Raven 5750, product from Columbian Chemical Company) and 2 parts of negatively charged control agent (S34, product from Orient Chemical Co., Japan) were sufficiently compounded, cooled and cut, coarse crushed, fine crushed, and graded to form particles of 5 to 30 μm. The particles were treated with 0.2% hydrophobic $SiO_2$ (R-972, product form Degussa AG) to obtain toner.

The toner composition obtained was tested by using IBM-4019 Laser Printer. The flowability indexes were tested by the use of the Powder Property Testing Device (Hosokawa Micro Japan) and printed by using IBM-4019 Laser Printer. The fixing temperature was 180° C. and copying was carried out to print for 2000 copies. The copying qualities such as consistency in copying, fixing property and transfer printing were determined. The storage property was tested by storing the boxes of the individual toner composition into an oven at 50° C. for 24 hours. If the toner compositions were aggloerated, it shows that the storage property is poor. The tested result of this example is also shown in Table 2.

COMPARATIVE EXAMPLE 1

63 parts of resin R1, 1 part of low molecular weight wax (Viscol 550P, product from Sanyo Kasei Japan), 36 parts of magnetic powder (Mapico Black B, product from Columbian Chemical Company), and 2 parts of negatively charged control agent (S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, Product from Degussa AG) to obtain toner.

COMPARATIVE EXAMPLE 2

63 parts of resin R2, 1 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 3

63 parts of resin R3, 1 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 4

63 parts of resin R4, 1 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 5

63 parts of resin R5, 1 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 6

63 parts of resin R1, 6 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 7

63 parts of resin R2, 6 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

COMPARATIVE EXAMPLE 8

63 parts of resin R3, 6 part of low molecular weight wax (Viscol 550P, product from Sanyo Kasei Japan), 36 parts of magnetic powder (Mapico Black B, product from Columbian Chemical Company), and 2 parts of negatively charged control agent(S-34, product from Orient Chemical Japan) underwent sufficient compounding, cooling and cutting, coarse crushing, fine crushing and grading to form particles of 5 to 30 μm. The particles were treated with 0.2% hydrophobic $SiO_2$ (R-972, product from Degussa AG) to obtain toner.

The above toner composition obtained in the examples 1 to 5 and the comparative examples 1 to 8 were used in copying. The flowability indexes were tested by the use of the Powder Property Testing Device (Hosokawa Micro Japan) and printed by using HP Laser Jet Series II. The fixing roller cleaner of the hot roller was removed and these individual toner compositions were used in the copying. The fixing temperature was 180° C. and copying was carried out to print for 2000 copies. The copying qualities such as consistency in copying, fixing property and transfer printing were determined. The storage property was tested by storing the boxes of the individual toner composition into an oven at 50° C. for 24 hours. If the toner compositions were aggloerated, it shows that the storage property is poor.

TABLE 2

COMPARISON OF PROPERTIES FOR EXAMPLES AND COMPARATIVE EXAMPLES

| | TONER | OFF-SETTING | FLOW-ABILITY STORAGE INDEX | FIX-ING | EVEN-NESS |
|---|---|---|---|---|---|
| EX. 1 | X | 64 | G | G | G |
| EX. 2 | X | 63 | G | G | G |
| EX. 3 | X | 63 | G | G | G |
| EX. 4 | X | 63 | G | G | G |
| EX. 5 | X | 63 | G | G | G |
| EX. 6 | X | 65 | G | G | G |
| EX. 7 | X | 64 | G | G | G |
| C/EX. 1 | V | 58 | G | G | F |
| C/EX. 2 | V | 60 | G | G | F |
| C/EX. 3 | V | 62 | G | G | F |
| C/EX. 4 | X | 64 | F | G | G |
| C/EX. 5 | X | 65 | F | G | G |
| C/EX. 6 | S | 55 | G | B | F |
| C/EX. 7 | X | 54 | G | B | F |
| C/EX. 8 | S | 53 | G | B | F |

X . . . No, V . . . Yes, S . . . Slight, G . . . Good, F . . . Fair, B . . . Bad While the invention has been described with respect to certain preferred exemplifications and embodiments, this not intended to limit the scope of the invention thereby, but solely by the claims appended hereto.

We claim:

1. An electrophotographic toner composition for development of images, comprising:

(a) an amount of 45 to 95% by weight of resin in toner of which the dynamic viscosity after being compounded and being fixed onto rollers, having been tested at a frequency rate of 6.28 RAD/sec, and at a strain of 10% is less than 20000 poise and the dissipation factor of which is smaller or equal to 1.3, and (b) a releasing agent being less than 3% by weight; which composition is free of silicone oil.

2. An electrophotographic toner composition as claimed in claim 1, wherein the resin is selected from the group consisting of styrene acrylic copolymer, styrene-butadiene copolymer, polyester and/or the mixture thereof.

3. An electrophotographic toner composition as claimed in claim 1, wherein the releasing agent is selected from the group consisting of low molecular weight polyethylene, low molecular weight polypropylene, metal salts of fatty acids, fatty acid esters, fatty acid ester having at least 17 carbon atoms, fatty acid amides or their mixture thereof.

4. An electrophotographic toner composition as claimed in claim 3, wherein the styrene-acrylic copolymer is obtained from the copolymerization of styrene, alpha-methyl-styrene, p-methyl styrene, o-methyl styrene, or m-methyl-styrene monomer and acrylic monomers.

5. An electrophotographic toner composition as claimed in claim 4, wherein the acrylic monomer is selected from methacrylate or acrylate.

6. An electrophotographic toner composition as claimed in claim 2, wherein the styrene-butadiene copolymer is selected from the group consisting of styrene, alpha-methyl styrene, p-methyl styrene, o-methyl styrene, or m-methyl styrene, and butadiene copolymer.

* * * * *